United States Patent [19]

Inagaki et al.

[11] Patent Number: 4,664,727

[45] Date of Patent: May 12, 1987

[54] ZIRCONIUM ALLOY HAVING SUPERIOR CORROSION RESISTANCE

[75] Inventors: Masahisa Inagaki, Hitachi; Ryutaro Jinbo, Hitachiota; Keiichi Kuniya; Isao Masaoka, both of Hitachi; Hideo Maki, Katsuta, all of Japan

[73] Assignee: Hitachi, Ltd., Tokyo, Japan

[21] Appl. No.: 506,393

[22] Filed: Jun. 21, 1983

[30] Foreign Application Priority Data

Jun. 21, 1982 [JP] Japan ..... 57-105403

[51] Int. Cl.[4] ..... C22C 16/00

[52] U.S. Cl. ..... 148/407; 420/422

[58] Field of Search ..... 148/11.5 F, 12.7 B, 148/133, 407, 421; 420/421, 422, 423

[56] References Cited

U.S. PATENT DOCUMENTS

| | | | |
|---|---|---|---|
| 3,645,800 | 2/1972 | Mock et al. | 148/11.5 F |
| 3,865,635 | 2/1975 | Hofvemstam | 148/11.5 F |
| 4,238,251 | 12/1980 | Williams et al. | 148/11.5 F |
| 4,279,667 | 7/1981 | Anthony et al. | 148/133 |
| 4,450,016 | 5/1984 | Vesterlund et al. | 148/12.7 B |

FOREIGN PATENT DOCUMENTS

| | | | |
|---|---|---|---|
| 71193 | 2/1983 | European Pat. Off. | 148/11.5 F |

OTHER PUBLICATIONS

Vesterlund et al, "Corrosion-Resistant BWR Zircaloy-4 Channels," Reactor Materials, vol. 34, 1980, pp. 237,238.

Andersson et al, "Beta Quenching of Zircaloy Cladding Tubes in Intermediate or Final Size-Methods to Improve Corrosion and Mechanical Properties".

*Primary Examiner*—L. Dewayne Rutledge

*Assistant Examiner*—S. Kastler

*Attorney, Agent, or Firm*—Antonelli, Terry & Wands

[57] ABSTRACT

A zirconium alloy having superior corrosion resistance, containing Sn of a small amount not less than the amount of Sn existing in the solid-solution of the zirconium alloy at a room temperature, and at least one kind of Fe and Cr each of a small amount not less than the amount of each of Fe and Cr existing in the solid-solution of the zirconium alloy at a room temperature, the zirconium alloy being annealed after the solution heat treatment at a temperature at which both the $\alpha$ phase and $\beta$ phase thereof are included in the zirconium alloy, the total amount of said at least one kind of Fe and Cr existing in the solid-solution of the zirconium alloy being not less than 0.26%.

15 Claims, 6 Drawing Figures

ZIRCONIUM ALLOY HAVING SUPERIOR CORROSION RESISTANCE

BACKGROUND OF THE INVENTION

This invention relates to a novel zirconium alloy, and more particularly to a zirconium alloy having superior corrosion resistance which is suitable as a structural material in a nuclear reactor which material is to be used in contact with water of a high temperature under a high pressure.

A zirconium alloy has an excellent corrosion resistance and a small neutron absorption cross section, so that it is used for producing a fuel assembly channel box 11, a fuel cladding tube 17, or the like which are structural members in an atomic power plant reactor as shown in FIG. 1. There are known, as a zirconium alloy used for these applications, zircalloy-2 (consisting essentially of about 1.5 wt % of Sn, about 0.15 wt % of Fe, about 0.1 wt % of Cr, about 0.05 wt % of Ni, and the balance zirconium), and zircalloy-4 (consisting essentially of about 1.5 wt % of Sn, about 0.2 wt % of Fe, about 0.1 wt % of Cr, and the balance zirconium). In the atomic power plant reactor shown in FIG. 1, reference numeral 10 represents a fuel assembly; 14 a nuclear fuel element; 18 an end plug; 19 an embedded bolt; 20 a space; and 24 a nuclear fuel material supporting means. Even in a zirconium alloy having excellent corrosion resistance, when it is subjected to water or steam at a high temperature and under a high pressure for a long time in the reactor, the oxide coating layer will become thick or the locally concentrated nodule-like corrosion (hereinafter, referred to as "nodular corrosion") will be caused, so that a thickness of non-oxidized portion will be reduced, with the result that the corrosion becomes a factor of decrease in strength of structural members.

To realize large degree of burn-up of atomic power nuclear fuel and to assure long-period operation, it is necessary to further improve corrosion resistance of a conventional zirconium alloy.

For improvement in such corrosion resistance of the zirconium alloy, a method is known for changing the distribution state of intermetallic compound phase ($Zr(Fe, Cr)_2$, $Zr(Ni, Fe)_2$ or $Zr_2(Ni, Fe)$) in the metal structure of the zirconium alloy by use of heat treatment. According to a Japanese Laid-Open Patent Publication No. 110412/76, there is disclosed a method of cooling the intermetallic compound phase, which has been evenly dispersed in a crystal grain and at a grain boundary, at a relatively slow cooling rate (30°–200° C./s) from a range of $[\alpha+\beta]$ phase coexisting temperature. According to a Japanese Laid-Open Patent Publication No. 70917/77, a method is disclosed which includes the steps of: quenching the zirconium alloy (at a cooling rate $\geqq$800° C./s) from a temperature range, at which a single phase of $\beta$ occurs, to provide solid-solution in which alloying elements constituting intermetallic compound phase are substantially completely in solid-solution; and annealing the zirconium alloy in a temperature range, at which $\alpha$ phase occurs, to selectively precipitate intermetallic compound phase at grain boundaries.

However, the precipitation of Fe, Cr or Ni at the grain boundary as intermetallic compound phase by use of these methods causes the amount of Fe, Cr or Ni existing in solid-solution of crystal grains to be reduced, resulting in deterioration of corrosion resistance of crystal grain. The inventors have discovered that such decrease of Fe, Cr or Ni in solid-solution is apt to cause the nodular corrosion progressing from a point within the crystal grain.

SUMMARY OF THE INVENTION

An object of the present invention is to provide a high corrosion resistance zirconium alloy in which, even if it is used in contact with the water or steam at a high temperature and under a high pressure for a long period of time, no nodular corrosion will be caused and in which oxide coating is prevented from becoming large in thickness or from being peeled off.

This object is accomplished by a superior corrosion resistance zirconium alloy containing Sn of a small amount not less than the amount of Sn existing in the solid-solution of the zirconium alloy at a room temperature, and at least one kind of Fe and Cr each of a small amount not less than the amount of each of Fe and Cr existing in the solid-solution of the zirconium alloy at a room temperature, the zirconium alloy being annealed after the solution heat treatment at a temperature at which both the $\alpha$ phase and $\beta$ phase thereof are included in the zirconium alloy, the total amount of said at least one kind of Fe and Cr existing in the solid-solution of the zirconium alloy being not less than 0.26%.

According to the present invention, Fe, Cr or Ni, which has a nobler electric potential than Zr, is solid-solutioned into the matrix to reduce an electric potential caused between the surface of oxide coating and the zirconium alloy through the oxide coating, thereby being capable of reducing an oxidization rate and preventing the occurrence of nodular corrosion.

Preferably, the zirconium alloy consists essentially, by weight, of 1–2% of Sn; at least one alloying element selected from the group consisting of 0.05–0.3% Fe and 0.05–0.2% Cr; 0–0.1% Ni and the balance Zr and inevitable impurities. Preferably, the content of Ni is 0.01–0.08%.

A method of producing the zirconium alloy of the present invention is as follows. Workability of a zirconium alloy obtained by solution heat treatment in which heating is effected up to an $\alpha$ and $\beta$ phases-coexisting temperature and then quenching is effected, is superior to that obtained by solution treatment regarding $\beta$ phase, so that the cold plastic working thereafter becomes easy. Thus, it is necessary to perform the solution treatment at that temperature. By this solution heat treatment, mild granular $\alpha$ phase and needle-like $\alpha'$ phase harder than the $\alpha$ phase are formed. This $\alpha'$ phase is obtained by quenching the $\beta$ phase. It is preferred that the solution heat treatment is effected at a temperature of 825°–965° C. for a short time not more than ten minutes.

After the solution treatment, the cold plastic working is done, and annealing is performed for causing the alloy to become mild. After cold working, final annealing is carried out to produce a final product so that the zirconium alloy of the product is substantially of all recrystallization structure. It is necessary to adjust the annealing temperature and time to maintain the amount of at least one kind of Fe and Cr both existing in the solid solution in the alloy to be 0.26% or more. Nodular corrosion will occur with an amount of less than 0.26% of at least one kind of Fe and Cr both existing in the solid solution, so that good corrosion resistance cannot be obtained. Preferably, the annealing temperature is in a range of 400°–700° C. and its holding time at the temperature is 1 to 5 hours. In particular, the annealing temperature of 400° to 640° C. is more preferable.

DESCRIPTION OF THE PREFERRED EMBODIMENTS

(EXAMPLE 1)

Figure 1:
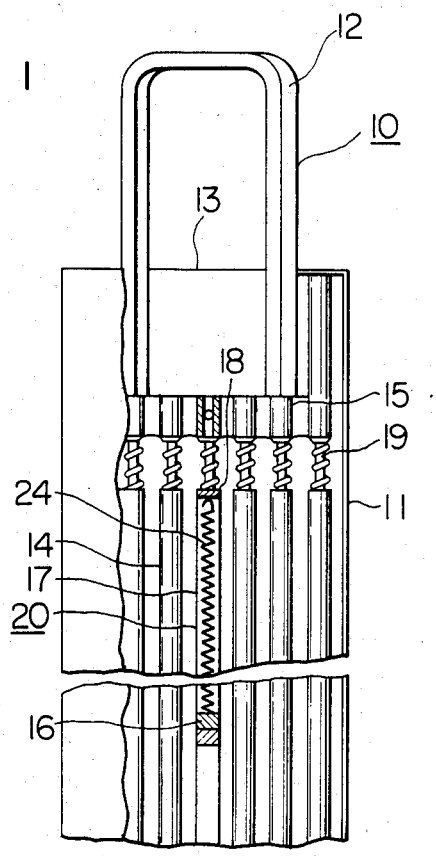
FIG. 1 is a cross sectional view with a part cut-away illustrating a nuclear reactor fuel assembly.
Figure 2:
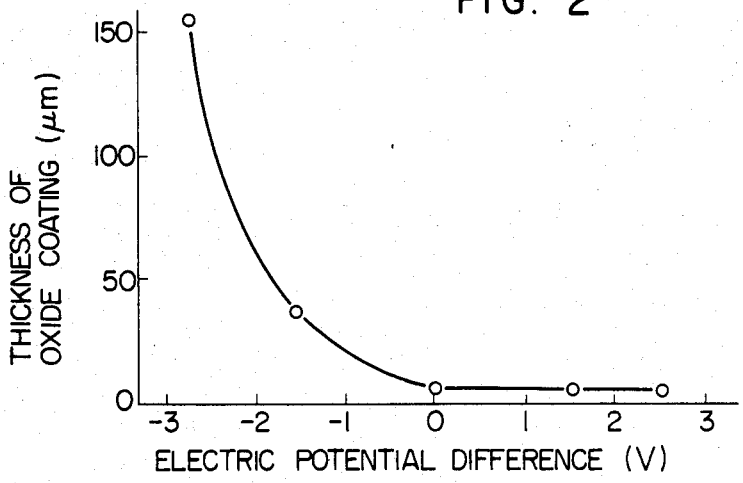
FIG. 2 is a diagram showing the influence on corrosion resistance by the electric potential difference between the zirconium alloy and the surface of oxide coating thereof.

FIG. 2 shows the variation in thickness of an oxide coating after it has been held for twenty hours in contact with the steam at 500° C. under a pressure of 105 kg f/cm$^2$ while applying a predetermined voltage by an external power supply by connecting platinum electrodes to the surface of oxide coating and to a plate material of zirconium alloy (zircalloy-4), respectively. The zirconium alloy contains 1.5 wt % of Sn, 0.20 wt % of Fe and 0.10 wt % of Cr, and it is obtained in such a manner that the ingot is produced by arc-melting and then forging, then it is subjected to solution heat treatment in $\beta$ phase. It will be appreciated from FIG. 2 that a case where oxidation is extremely promoted is of one where the electric potential of zircalloy-4 plate material is at negative voltage with respect to the surface of oxide coating and that oxidation is suppressed with a decrease in the difference of electric potential.

The following table shows the details of heat treatments performed for the annealing material (at 600° C. for 5 hours) of zircalloy-4 to cause variation in the ratio of the amount of Fe and Cr both existing in the solid-solution of matrix to the total amount of Fe and Cr in zirconium alloy (hereinafter referred to as "the degree of solid-solutioned Fe and Cr in matrix").

TABLE

| | Solution heat treatment | | | Annealing | |
|---|---|---|---|---|---|
| No. | Temperature (°C.) | Holding time (minutes) | Cooling rate (°C./s) | Temperature (°C.) | Holding time (h) |
| 1 | — | — | — | 650 | 50 |
| 2 | 900 | 5 | 300 | — | — |
| 3 | 900 | 5 | 300 | 600 | 2 |
| 4 | 847 | 5 | 300 | — | — |
| 5 | 847 | 5 | 300 | 600 | 2 |
| 6 | 847 | 5 | 300 | 650 | 2 |
| 7 | 943 | 5 | 300 | 650 | 2 |

According to the heat treatment No. 1, the annealing at 650° C. for 5 hours is additionally performed to complete the annealing so that Fe and Cr may be substantially completely precipitated as an intermetallic compound phase. According to the heat treatments Nos. 2 and 4, the degree of solid-solutioned Fe and Cr in matrix is changed by use of three kinds of solution treatment temperatures 943° C., 900° C., and 847° C. According to the heat treatments Nos. 3 and 5–7, after the solution heat treatments at three kinds of solution heat treatment temperatures of 900° C., 847° C. and 943° C. to obtain the solid-solution of Fe and Cr, the annealing is carried out at 600° C. and 650° C. to re-precipitate a portion of each of Fe and Cr having been solid-solutioned. By performing such heat treatments Nos. 2–7, the degree of solid-solutioned Fe and Cr into the matrix varies within a range of 60–99%.

The metal microstructures of each heat treatment material specified in the above table are magnified 10,000 times for observation, and the diameter of the precipitations and the number of pieces thereof are measured to obtain a volume factor [fvol] of each precipitation.

The degree [C %] of the solid-solutioned Fe and Cr into the matrix for the heat treatment materials in Nos. 2–7 is calculated by the following equation (1) while using the volume factor [fvo*l] of precipitation for the complete annealing material (heat treatment No. 1) as the standard (100% precipitation):

$$C\,[\%] = \left(1 - \frac{fvol}{fvol^{*}}\right) \times 100 \qquad (1)$$

wherein, fvol indicates a volume factor of precipitation for each heat treatment material in Nos. 2–7.

Figure 3:
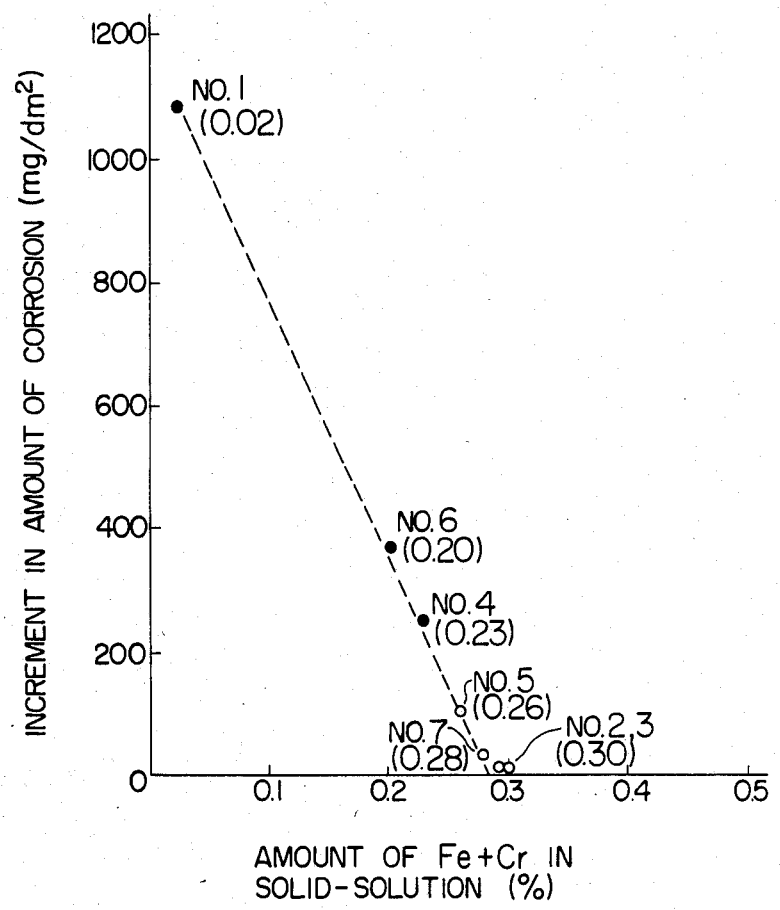
FIGS. 3 and 4 are diagrams showing the relation between the corrosion resistance of zirconium alloy and the volume factor of precipitation, respectively.

Referring to FIG. 3, there is shown a diagram to explain the influence of the amount of solid-solutioned Fe+Cr in matrix on the increased amount of corrosion due to oxidation with respect to each heat-treated materials specified in Nos. 1–7 in the table, which materials have been held in the steam at 500° C. under a pressure of 105 kg f/cm$^2$ for 60 hours, which amount of solid-solutioned Fe+Cr was obtained from the volume factor [fvol] of precipitation. In FIG. 3, an indication of black circle [●] means the heat treatment material in which nodular corrosion has been caused while a white circle shows the cases of no nodular corrosion. It will be understood from FIG. 3 that when the amount of solid-solutioned Fe and Cr is 0.26 percents or more by weight, no nodular corrosion is caused and the increase in corrosion amount is not more than 100 mg/dm$^2$ and the corrosion amount becomes extremely small.

(EXAMPLE 2)

A tube and a flat plate of the zirconium alloy were produced which consists essentially, by weight, of 1.50% Sn, 0.15% Fe, 0.11% Cr, 0.05% Ni, and the balance Zr and inevitable impurities. Heat-treated materials were obtained by: (1) cold rolling three times with annealing at 700° C. being interposed without performing $\beta$ phase quenching; (2) cold rolling once after quenching from 885° C.; (3) cold rolling once after quenching from 945° C.; (4) cold rolling once after quenching from 1025° C.; and (5) cold rolling three times with annealing at 600° C. being interposed after quenching from 945° C. These five kinds of materials were finally annealed for two hours at 400°, 500°, 540°, 577°, 600°, 650°, and 690° C., respectively.

Figure 4:
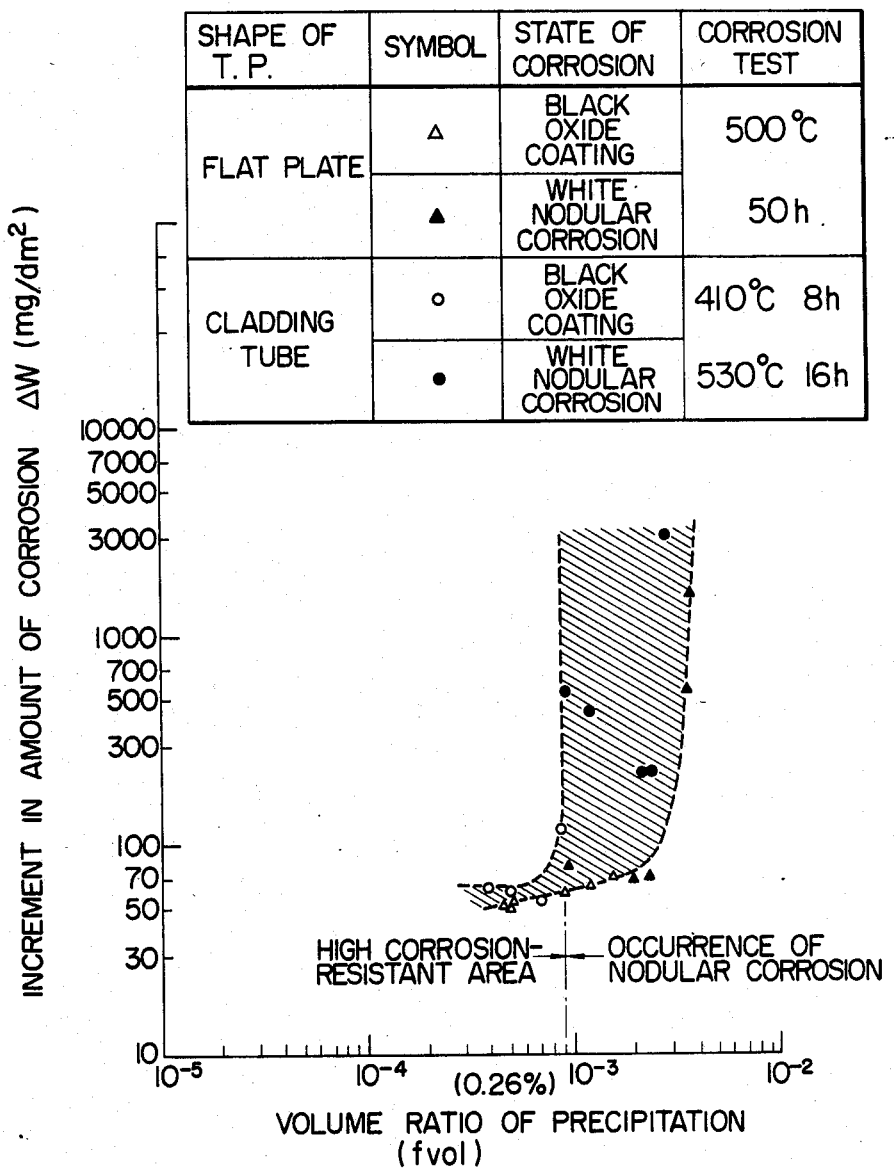

FIG. 4 is a diagram showing the results of corrosion tests for those samples in the steam under a pressure of 105 kg/cm$^2$ under such conditions as shown in FIG. 4. As shown in FIG. 4, it has been found that when the amount of solid-solutioned Fe, Ni and Cr is 0.26% or more, no nodular corrosion is caused while uniform corrosion were caused.

(EXAMPLE 3)

It will be described hereinbelow an example of production of a nuclear fuel cladding tube for reactor comprising the zirconium alloy of the present invention.

Figure 5:
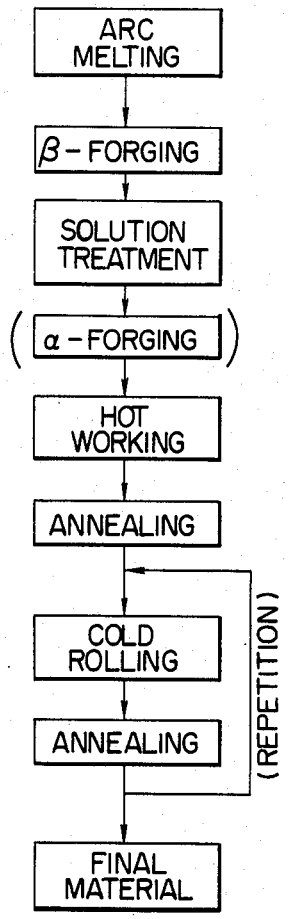
FIGS. 5 and 6 are flowcharts showing a process of producing a nuclear fuel cladding tube for nuclear reactor, made of zirconium alloy, respectively.

FIG. 5 is a flowchart showing a method of producing the fuel cladding tube. The zirconium alloy consisting of predetermined compositions is formed into a ingot through arc-melting and further forged at a temperature range of $\beta$ phase. After this forging, there is effected such solution heat treatment that it is heated and held at a temperature range at which both $\alpha$ and $\beta$ phases exist and is cooled from that temperature. Then, the material formed into a tube of a predetermined cylindrical shape is made thin in thickness and small in diameter by hot rolling. Thereafter, annealing is performed at a predetermined temperature. Furthermore, cold working and annealing are repeated to make the tube small in diameter and thin in thickness. Then, final annealing is carried out to produce a product of zirconium alloy having substantially all re-crystallization structure. After the solution treatments, heating is controlled so that the total amount of solid-solutioned Fe, Cr and Ni may be 0.26 percents or more. The amount of the solid-solutioned Fe, Cr and Ni is calculated in the same manner as described previously from the structure of alloy.

Figure 6:
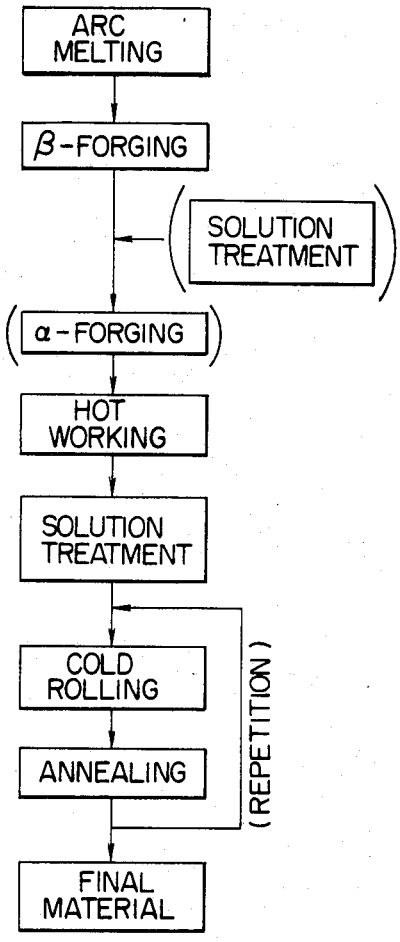

FIG. 6 is a flowchart showing another method of producing a nuclear fuel cladding tube for reactor. This method is substantially the same as the method described regarding FIG. 5 except that there is effected the solution treatment comprising the steps of: holding a material at a temperature range, at which both $\alpha$ and $\beta$ phases exist, after hot working by use of hot extrusion; and water-cooling the material. A solution heat treatment to be effected after the $\beta$ phase-forming may be omitted.

According to the present invention described above, it is possible to obtain a fuel cladding tube with superior corrosion resistance.

The above process for production will be explained in detail hereinbelow.

(1) Melting:

Predetermined alloy elements (Sn, Fe, Cr, Ni, etc.) are added to a zirconium sponge used as a material, to thereby produce a cylindrical briquette by compression molding. This briquette is welded under an inert gas atmosphere to make an electrode, then this process is repeated twice in a consuming electrode type arc welding furnace, and then the electrode is vacuum-melted, thereby obtaining an ingot.

(2) $\beta$ forging:

The ingot is preheated to a $\beta$ region temperature (generally, up to about 1000° C.) to perform the forging for forming.

(3) Solution treatment:

After the $\beta$ forging or hot rolling which will be explained later, the ingot is heated to a temperature region of $\alpha+\beta$ phases, thereafter it is quenched (generally, by the water). By this solution heat treatment, the alloy elements which have been segregated are dispersed uniformly, so that the metal structure is improved.

(4) a forging:

To remove the oxide coating on the surface caused by the solution heat treatment and to adjust the dimensions, preheating is done in a temperature range in the $\alpha$ region at about 700° C., thereafter forging is performed.

(5) Machining and Copper Coating:

The bloom after $\alpha$ forging is machined and a hole is formed to obtain a hollow billet. This is subjected to copper coating to prevent oxidation and gas absorption and to improve lubrication.

(6) Hot rolling:

The copper coated billet at a temperature in the $\alpha$ range near 700° C. is extruded by passing it through the dies with pressure to produce an extruded crude tube.

(7) Intermediate annealing:

Annealing is carried out generally at 400°-700° C., preferably 400°-640° C., under high vacuum of $10^{-4}$-$10^{-5}$ Torr to relieve strains caused by working.

(8) Intermediate rolling:

The extruded crude tube is made small in outer diameter and thin in thickness by rolling work at room temperature. The rolling work is repeated several times with the intermediate annealing being interposed until it reaches a predetermined dimensions.

(9) Final annealing:

Recrystallization annealing is performed generally at about 580° C. under high vacuum of $10^{-4}$-$10^{-5}$ Torr to obtain a substantially all recrystallization structure.

Although the shapes of fuel channel, box, fuel spacer, etc. made of the zirconium based alloy are different, similar working methods are fundamentally used to make these. That is to say, the melting, $\beta$ forging, solution heat treatment, hot plastic working, plastic working with intermediate annealing interposed at room temperature, and final plastic working, then final annealing are performed.

According to the present invention, a zirconium alloy with excellent corrosion resistance in which no nodular corrosion is caused is obtained. With a structural material in a nuclear plant reactor using such zirconium alloy, oxidation is suppressed and the occurrence of nodular corrosion can be prevented so that it is possible to prevent the structural member from becoming small in thickness and oxide coating from being peeled off. Therefore, these results in improvement in reliability of members and long life of the members in the reactor, thereby realizing large degree burn-up of nuclear fuel.

Although preferred embodiments of the invention are specifically described herein, it will be appreciated that many modifications and variations of the present invention are possible in light of the above teachings and within the purview of the appended claims without departing from the spirit and intended scope of the invention.

What is claimed is:

1. A zirconium alloy having superior corrosion resistance, containing Sn of a small amount not less than the amount of Sn existing in the solid-solution of the zirconium alloy at a room temperature, and at least one element selected from the group consisting of Fe and Cr, each of a small amount not less than the amount of each of Fe and Cr both existing in the solid-solution of the zirconium alloy at a room temperature, and with or without Ni, the zirconium alloy being annealed after the solution heat treatment, the solution heat treatment being at a temperature at which both the $\alpha$ phase and $\beta$ phase thereof are included in the zirconium alloy, the total amount of said at least one element of Fe and Cr; or said at least one element of Fe and Cr, and Ni; existing in the solid-solution of the zirconium alloy, after the final annealing, after the solution heat treatment, being not less than 0.26 weight %, whereby nodular corrosion of said alloy is prevented.

2. A zirconium alloy having superior corrosion resistance as claimed in claim 1, consisting essentially, by weight, of 1–2% Sn, at least one element selected from the group consisting of 0.05–0.3% Fe and 0.05–0.2% Cr, 0–0.1% Ni; with the proviso that when the alloy contains no Ni, Fe is contained in an amount of 0.06–0.3%; and the balance Zr and inevitable impurities.

3. A zirconium alloy having superior corrosion resistance as claimed in claim 1 or claim 2, wherein the solution heat treatment is effected by maintaining the zirconium alloy at a temperature of 825° to 965° C. for a period of time not more than 10 minutes, then the zirconium alloy being quenched from said temperature.

4. A zirconium alloy having superior corrosion resistance as claimed in claim 3, wherein the annealing is effected at a temperature of 400°–700° C. for a period of time of 1–5 hours.

5. A zirconium alloy having superior corrosion resistance as claimed in claim 2, wherein the time and temperature of said annealing are adjusted to maintain the total amount of said at least one element of Fe and Cr; or at least one kind of Fe and Cr, and Ni; existing in the solid-solution of the zirconium alloy at not less than 0.26 weight %.

6. A zirconium alloy having superior corrosion resistance as claimed in claim 5, wherein the annealing is performed at least two times, after respective cold working steps.

7. A zirconium alloy having superior corrosion resistance as claimed in claim 6, wherein the annealing is performed three times, after respective cold working steps.

8. A zirconium alloy having superior corrosion resistance as claimed in claim 1 or claim 7, said alloy having been formed into a nuclear fuel cladding tube.

9. A zirconium alloy having superior corrosion resistance as claimed in claim 1 or claim 7, said alloy having been formed into a nuclear fuel assembly channel box.

10. A zirconium alloy having superior corrosion resistance as claimed in claim 1 or claim 7, said alloy having been formed into at least one of a nuclear fuel cladding tube and a nuclear fuel assembly channel box, wherein said fuel cladding tube is adapted to hold a nuclear fuel substance, and wherein said fuel assembly channel box is adapted to integrally support a plurality of the fuel cladding tubes.

11. A zirconium alloy having superior corrosion resistance as claimed in claim 2 or claim 7, wherein Ni is contained in an amount of 0.01–0.08 weight %.

12. A zirconium alloy having superior corrosion resistance as claimed in claim 5, wherein the annealing temperature is 400°–640? C.

13. A zirconium alloy having superior corrosion resistance as claimed in claim 1 or claim 7, wherein the total amount of said at least one kind of Fe and Cr; or at least one element of Fe and Cr, and Ni; in said solid-solution is at least 0.28 weight %.

14. A zirconium alloy having superior corrosion resistance as claimed in claim 1, wherein the alloy after final annealing is substantially all recrystallization structure.

15. A zirconium alloy having superior corrosion resistance as claimed in claim 1, wherein the solid-solution of the zirconium alloy is provided by performing the solution heat treatment at a temperature of 825°–965° C.

* * * * *